United States Patent [19]

Jacobs

[11] Patent Number: 4,905,330

[45] Date of Patent: Mar. 6, 1990

[54] COMBINATION FURNITURE AND EXERCISE DEVICE

[76] Inventor: Lawrence I. Jacobs, 2202 B Pacific Ave., Costa Mesa, Calif. 92627

[21] Appl. No.: 314,159

[22] Filed: Feb. 23, 1989

[51] Int. Cl.[4] ..... A47C 20/00

[52] U.S. Cl. ..... 5/431; 5/465

[58] Field of Search ..... 5/12 R, 431, 432, 433, 5/437, 446, 465; 272/144

[56] References Cited

U.S. PATENT DOCUMENTS

| | | | |
|---|---|---|---|
| 885,243 | 4/1908 | Haas . | |
| 2,623,574 | 12/1952 | Damsch | 155/17 |
| 3,469,882 | 9/1969 | Larsen | 297/118 |
| 3,498,605 | 3/1970 | Büttner | 5/465 X |
| 3,555,581 | 1/1971 | Friant | 5/465 |
| 3,561,757 | 3/1971 | Schillig | 272/60 |
| 3,628,790 | 12/1971 | Gordon | 272/64 |
| 3,672,720 | 6/1972 | Wilson | 297/118 |
| 3,775,785 | 12/1973 | Mittendorf | 5/341 |
| 3,902,759 | 9/1975 | Monteforte et al. | 297/456 |
| 4,173,045 | 11/1979 | Osborn | 5/465 X |
| 4,518,203 | 5/1985 | White | 5/465 X |
| 4,802,249 | 2/1989 | Bills | 5/465 X |

FOREIGN PATENT DOCUMENTS

| | | | |
|---|---|---|---|
| 546541 | 4/1956 | Belgium | 5/465 |
| 1487312 | 6/1964 | France | 5/12 R |

OTHER PUBLICATIONS

Advertising brochure–"Bodyslant".

*Primary Examiner*—Gary L. Smith
*Assistant Examiner*—Michael J. Milano
*Attorney, Agent, or Firm*—Zarley, McKee, Thomte, Voorhees & Sease

[57] ABSTRACT

Five cushion pieces are pivotally interconnected to provide multiple furniture and exercise pieces. A pair of wedge shaped pieces are pivotally interconnected to a rectangular piece for pivoting about a common axis. A pair of half size rectangular pieces are pivotally interconnected to each other with one of the pieces being pivotally connected to the rectangular piece at an edge diagonally opposite the pivotal connection of the rectangular piece to the two wedge pieces.

1 Claim, 2 Drawing Sheets

COMBINATION FURNITURE AND EXERCISE DEVICE

BACKGROUND OF THE INVENTION

An important object of some furniture is for it to function in as many ways as possible. Space and budgets are often limited and thus the more ways a piece of equipment can be used, the more valuable it is to the owner.

I have previously produced a combination furniture and exercise device comprising three pieces pivoted together about a common axis. Two of the pieces were wedge shaped while the third was rectangular in cross section. It could produce a bed, incline bed or ottoman. It would be desirable to add additional furniture and exercise configurations to this unit.

SUMMARY OF THE INVENTION

I have added to my previous combination furniture and exercise device two rectangular sections or pieces which are pivotally interconnected. Each of them have a width equal to one half the width of the original rectangular piece connected to the two wedge shaped pieces. The unit is now capable of being arranged in the shape of a love seat, lounge, ottoman or sit-up exercise device among other possible configurations.

A total of five pieces are utilized, all interconnected. The wedge shaped pieces comprise the first two pieces while the rectangular piece is the third, and the fourth and fifth pieces are the one-half size rectangular pieces. The fourth rectangular piece is pivoted to the third rectangular piece at an edge diagonally opposite the edge to which the first and second wedge-shaped pieces are connected to the rectangular third piece. The fifth rectangular piece is pivotally connected to the fourth piece at an edge diagonally opposite the fourth rectangular piece's connection to the third rectangular piece. This specific structure and arrangement allows for a variety of different furniture and exercise piece configurations.

DESCRIPTION OF THE PREFERRED EMBODIMENT

Figure 1:
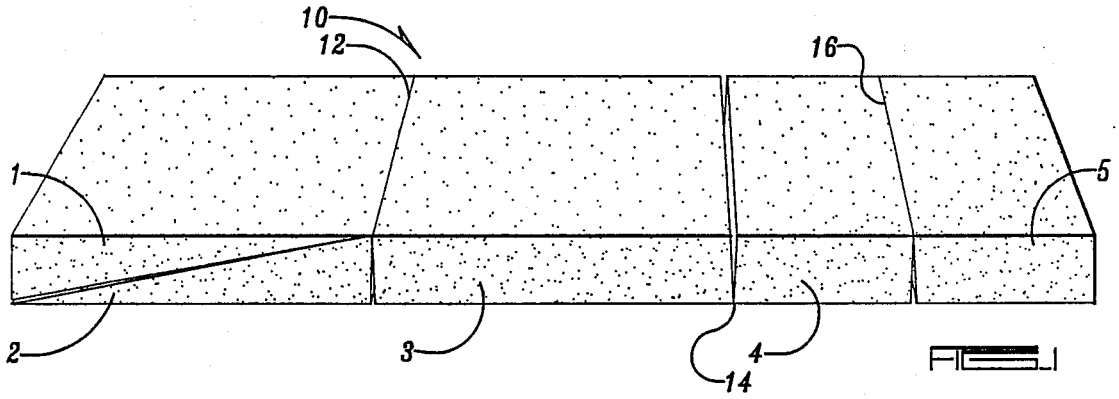
FIG. 1 is a perspective view of the combination furniture and exercise device fully extended as a bed.

The combination furniture and exercise device of this invention is referred to generally in FIG. 1 by the reference numeral 10 and is shown in the configuration of a bed. The device includes five interconnected sections or pieces identified by the numbers 1–5. The first two pieces ar wedge shaped and are right angle in cross section. The wedge shaped pieces 1 and 2 are pivotally interconnected to each other and to the edge 12 of the rectangular piece 3. A fourth piece rectangular in shape and one-half the size of the third rectangular in shape piece is pivotally connected at an edge 14 on the rectangular piece 3 diagonally opposite the edge 12. A second rectangular piece 5 one-half the size of the rectangular piece 3 is pivotally interconnected at the edge 16 of the rectangular piece 4. Thus as seen in FIG. 1 an elongated wholly extended bed is provided.

Figure 2:
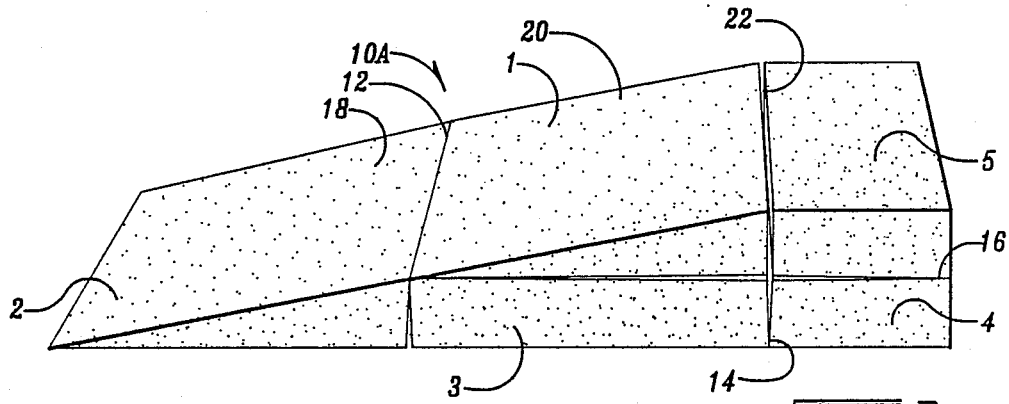
FIG. 2 is a perspective view thereof in an incline bed or slant configuration.

In FIG. 2 an incline bed 10A is shown wherein the wedge shaped pieces 1 and 2 are arranged with surfaces 18 and 20 in a common sloping plane. Wedge piece 1 is stacked on top of rectangular piece 3. The rectangular piece 5 is stacked on top of the rectangular piece 4 and provides a level extension to the upper edge 22 of the wedge piece 1.

Figure 3:
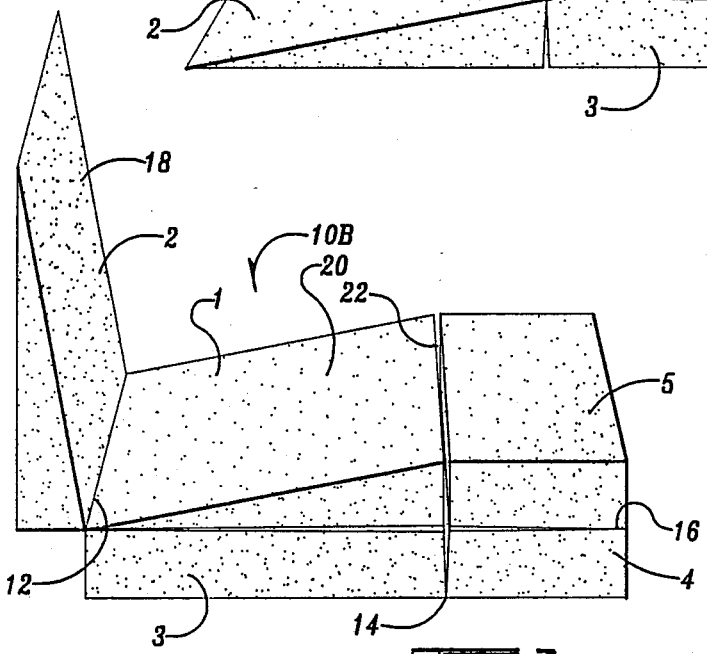
FIG. 3 is a perspective view thereof showing a lounge configuration.

A lounge chair 10B is shown in FIG. 3 and is similar to the incline bed 10A of FIG. 2 except that the wedge piece 1 is pivoted to a vertical position to provide a back for the lounge chair 10B. The rectangular pieces 4 and 5 provide an extension and support for the user's legs.

Figure 4:
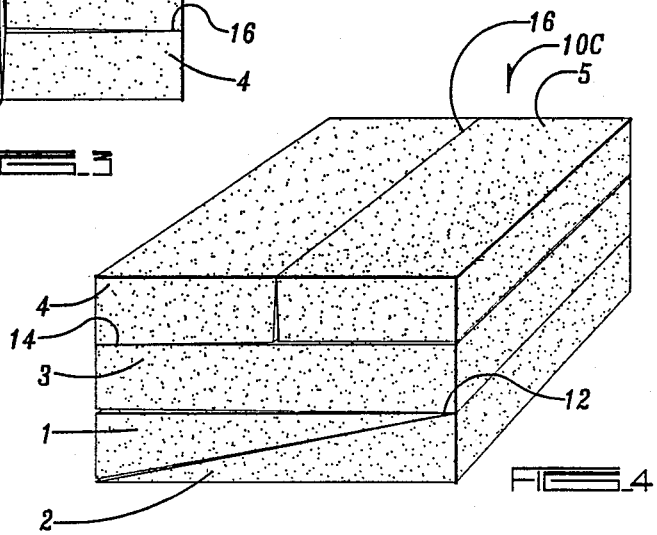
FIG. 4 is a perspective view thereof showing an ottoman configuration.

An ottoman 10C is illustrated in FIG. 4 and is the result of wedge pieces 1 and 2 being stacked and the rectangular piece 3 being placed on top of the wedge pieces 1 and 2. The rectangular pieces 4 and 5 are extended and stacked on top of the rectangular piece 3.

Figure 5:
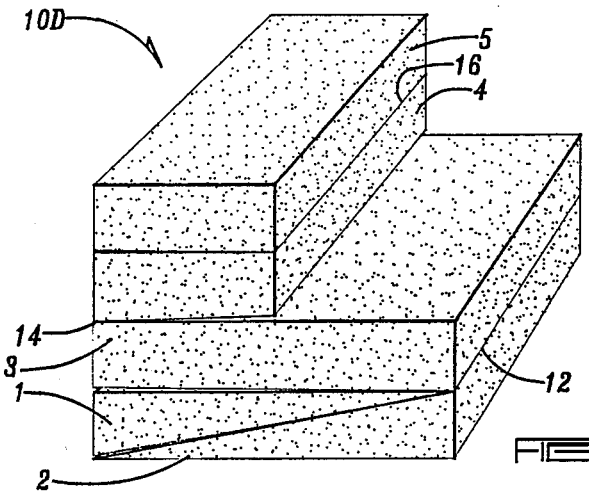
FIG. 5 is a perspective view thereof showing a love seat configuration.

A love seat 10D is seen in FIG. 5 wherein the wedge pieces 1 and 2 are stacked with the rectangular piece on top and a seat is provided by the rectangular pieces 4 and 5 being stacked one upon the other.

Figure 6:
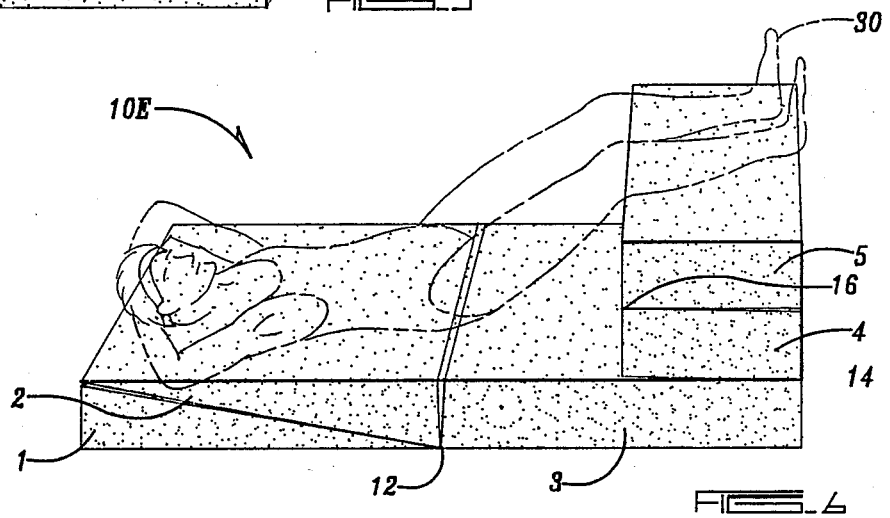
FIG. 6 is a perspective view thereof showing a sit-up exercise device configuration.

In performing sit up exercises, it is important to keep the feet raised to avoid injury to the back. A comfortable exercise piece of equipment is provided in FIG. 6 wherein a sit up exercise device 10E is shown. The wedge piece 2 is placed on top of the wedge piece 1 and extended from the rectangular piece 3 the rectangular pieces 4 and 5 are stacked one upon the other to provide the ledge on which the exerciser's feet 30 are placed. It is important to note that the component pieces 1, 2 and 3 have been inverted from the position shown in FIG. 1 thereby making it possible for the rectangular pieces 4 and 5 to assume the position shown to provide the ledge for the user's feet 30.

Figure 7:
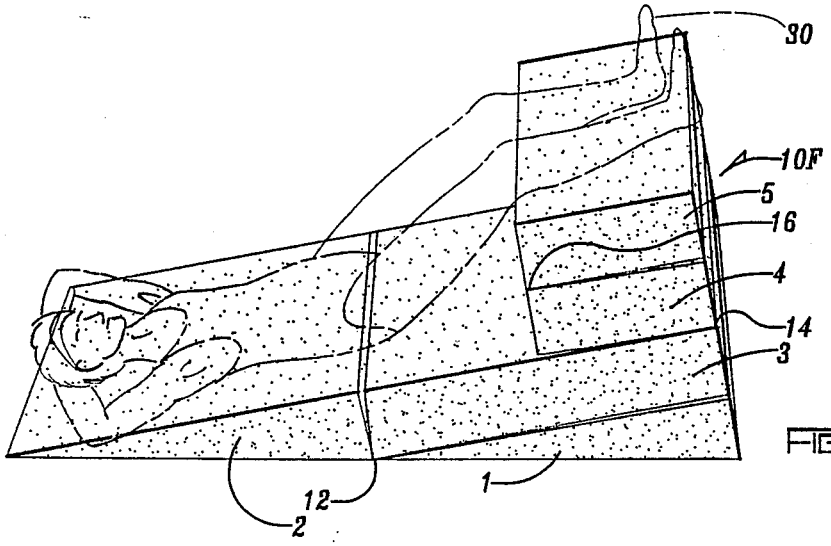
FIG. 7 is a perspective view thereof showing a slanted sit-up exercise device configuration.

An alternate sit-up position device 10F is shown in FIG. 7 where the exercise piece of FIG. 2 is inverted and the rectangular pieces 4 and 5 are stacked on top of rectangular piece 3. The exerciser now has a higher degree of difficulty over the device of FIG. 2 for doing sit-ups as he is in a slant position.

Thus it is seen that five cushion pieces appropriately interconnected and arranged one relative to the others can provide a multiple of different pieces of furniture and exercise devices. Space and costs requirements are thus minimized. The addition of the half sized rectangular pieces 4 and 5 to the other three pieces significantly enhances the possibilities of how the furniture and exercise piece may be used.

I claim:

1. A combination furniture and exercise device comprising, first and second wedge-shaped pieces pivotally interconnected at a common axis to a first edge of a rectangular third piece, fourth and fifth rectangular pieces pivotally interconnected and being substantially the same size and one half the width each of said rectangular third piece, a first edge of said fourth piece being pivotally connected to said rectangular third piece at an edge of said third piece diagonally opposite said first edge of said third piece and said fifth piece being pivotally connected to a second edge of said fourth piece diagonally opposite said first edge of said fourth piece, and said first and second wedge shaped pieces having slanted top surfaces in parallel spaced apart planes and said rectangular piece being stacked on the top surface of said second wedge shaped piece and said fifth rectangular piece being stacked on said fourth rectangular piece which is stacked on said third rectangular piece to form a slanted raised foot sit-up exercise device.

* * * * *